US011654476B2

(12) United States Patent
Choudhary et al.

(10) Patent No.: US 11,654,476 B2
(45) Date of Patent: May 23, 2023

(54) HYBRID CORE FOR MANUFACTURING OF CASTINGS

(71) Applicant: GM GLOBAL TECHNOLOGY OPERATIONS LLC, Detroit, MI (US)

(72) Inventors: Lokesh Choudhary, Karnataka (IN); Tiruttani Munikamal, Karnataka (IN); Qigui Wang, Rochester Hills, MI (US); Liang Wang, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 408 days.

(21) Appl. No.: 17/034,530

(22) Filed: Sep. 28, 2020

(65) Prior Publication Data

US 2022/0097125 A1 Mar. 31, 2022

(51) Int. Cl.

| | |
|---|---|
| ***B22C 9/10*** | (2006.01) |
| ***B22D 15/00*** | (2006.01) |
| ***B22D 17/22*** | (2006.01) |

(52) U.S. Cl.

CPC ..... *B22C 9/103* (2013.01); *B22D 15/00* (2013.01); *B22D 17/22* (2013.01)

(58) Field of Classification Search

CPC ..... B22C 9/10; B22C 9/103; B22D 15/00
See application file for complete search history.

(56) References Cited

U.S. PATENT DOCUMENTS

| | | | | | |
|---|---|---|---|---|---|
| 2,864,142 | A * | 12/1958 | Jenkins | B22D 15/00 164/355 |
| 5,445,210 | A * | 8/1995 | Brassell | B22C 9/10 164/369 |
| 6,913,064 | B2 * | 7/2005 | Beals | B22C 9/10 164/369 |
| 6,962,189 | B2 * | 11/2005 | Buckley | B22D 25/02 164/72 |

FOREIGN PATENT DOCUMENTS

| | | | | |
|---|---|---|---|---|
| CN | 105598380 | A * | 5/2016 | |
| CN | 108746534 | A * | 11/2018 | |
| DE | 19534836 | A1 | 3/1997 | |
| DE | 60307467 | T2 | 1/2007 | |
| DE | 60311824 | T2 | 10/2007 | |
| DE | 102011079356 | A1 | 1/2013 | |
| EP | 2554294 | A2 | 2/2013 | |
| WO | 0226419 | A1 | 4/2002 | |
| WO | WO-2014111573 | A1 * | 7/2014 | B22C 9/02 |

* cited by examiner

*Primary Examiner* — Kevin E Yoon
(74) *Attorney, Agent, or Firm* — Quinn IP Law

(57) ABSTRACT

A hybrid core for manufacturing a cast component, the hybrid core including a sand core portion having an exterior shape configured to define an interior feature of the cast component. The hybrid core also includes a metal chill element embedded within the sand core portion. The metal chill element is configured to locally absorb heat energy from the cast component during cooling of the cast component and solidification thereof. The metal chill element is constructed and arranged within the sand core portion to be (Continued)

removed during shake out from the cast component subsequent to the solidification thereof. A system and a method for manufacturing a cast component using such a hybrid core are also envisioned.

20 Claims, 5 Drawing Sheets

HYBRID CORE FOR MANUFACTURING OF CASTINGS

INTRODUCTION

The present disclosure relates to a hybrid core for manufacturing of cast components.

Casting is a manufacturing process in which a liquid material is usually poured into a mold, which contains a hollow cavity of the desired shape, and then allowed to solidify. The solidified part is also known as a casting, which is ejected or broken out of the mold to complete the process. Casting is most often used for making complex shapes that would be otherwise difficult or uneconomical to make by other methods. Sand casting, also known as sand mold casting, is a metal casting process characterized by using sand as the mold material. The term "sand casting" may also refer to an object produced via the sand-casting process.

Certain bulky equipment like machine tool beds, ship propellers, combustion engine components (such as cylinder heads, engine blocks, and exhaust manifolds), etc., may be cast more easily in the required size, rather than be fabricated by joining several small pieces. The mold cavity and gating system are typically created by compacting the sand around models called patterns, by carving directly into the sand, or by 3D printing. The mold includes runners and risers that enable the molten metal to fill the mold cavity by acting as reservoirs to feed the shrinkage of the casting as it solidifies. During the casting process, metal is first heated until it becomes liquid and is then poured into the mold after certain melt treatment such as degassing, adding grain refiner, and adjusting alloy element contents. The mold gradually heats up after absorbing the heat from liquid metal. Consequently, the molten metal is continuously cooled until it solidifies. After the solidified part (the casting) is taken out of the mold and following a shake out, excess material in the casting (such as the runners and risers) is removed.

Cores are frequently used for sand casting components with internal cavities and reentrant angles, i.e., interior angles greater than 180 degrees. For example, cores are used to define multiple passages in engine blocks, cylinder heads, and exhaust manifolds. Cores are typically disposable items constructed from materials such as sand, clay, coal, and resin. Core materials generally have sufficient strength for handling in the green state, and, especially in compression, to withstand the forces, e.g., material weight, of casting, sufficient permeability to allow escape of gases, good refractoriness to withstand casting temperatures. Because cores are normally destroyed during removal from the solidified casting, core materials are generally selected to permit core break-up during shake out. The core material is typically recycled.

SUMMARY

A hybrid core for manufacturing a cast component, the hybrid core including a sand core portion having an exterior shape configured to define an interior feature of the cast component. The hybrid core also includes a metal chill element embedded within the sand core portion. The metal chill element is configured to locally absorb heat energy from the cast component during its cooling and solidification thereof. The metal chill element is constructed and arranged within the sand core portion to be removed during shake out from the cast component subsequent to the solidification thereof.

The metal chill element may have a solid cross-section.

Alternatively, the metal chill element may have a hollow cross-section, or have a varying cross-section where one section is hollow and another is solid.

The metal chill element may have a unitary or single-piece construction.

Alternatively, the metal chill element may include a multi-piece construction configured to facilitate removal of the metal chill element during shake out from the cast component.

The metal chill element having multi-piece construction may include a first piece of the metal chill element interconnected with a second piece of the metal chill element.

The metal chill element may be defined by an exterior surface. In such an embodiment, the metal chill element may include a coating on the exterior surface positioned to contact the cast component and configured to minimize sticking of the metal chill element to the interior feature of the cast component. The coating is intended to not restrict heat transfer from the cast component to the metal element.

The coating may include at least one of ceramic, nitride, silicon, and titanium.

The coating may have a thickness in a range of 50 nanometers to 5 microns.

The metal chill element may have an exterior shape configured to follow a shape or geometry of the interior feature of the cast component.

A system and a method for manufacturing a cast component using such a hybrid core are also disclosed.

The above features and advantages, and other features and advantages of the present disclosure, will be readily apparent from the following detailed description of the embodiment(s) and best mode(s) for carrying out the described disclosure when taken in connection with the accompanying drawings and appended claims.

DETAILED DESCRIPTION

Terms such as "above", "below", "upward", "downward", "top", "bottom", etc., are used in the present disclosure descriptively for the figures, and do not represent limitations on the scope of the disclosure, as defined by the appended claims.

Figure 1:
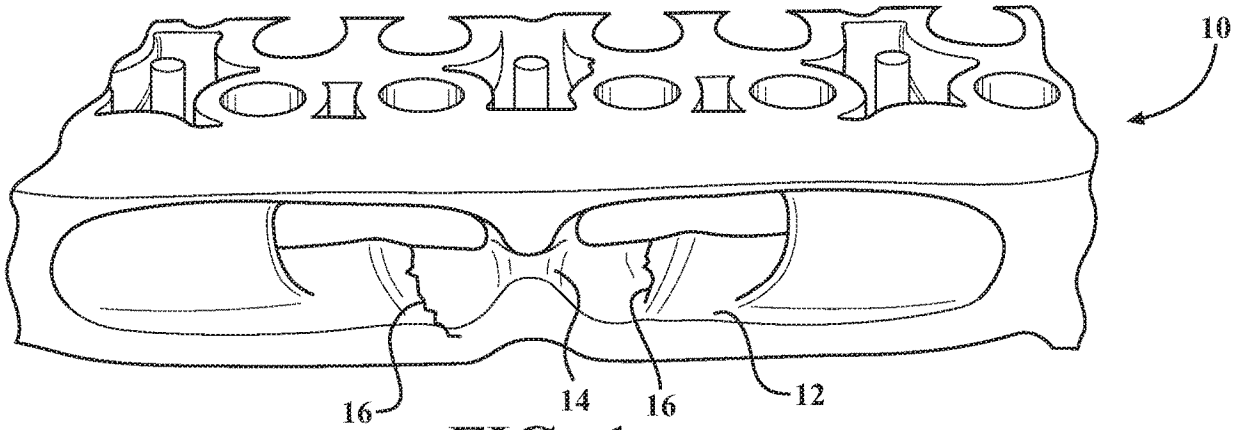
FIG. 1 is a schematic partial view of an embodiment of a cast component having an interior feature generally formed with the aid of a casting core, according to the disclosure.

Referring to FIG. 1, a cast component 10 is depicted. The cast component 10 is specifically a "sand casting", also known as sand mold casting. Generally, a sand casting is a metal casting produced by using sand as the mold material. The cast component 10 may be a cylinder head (shown in FIG. 1) having an integrated exhaust manifold, such as for an internal combustion gasoline engine or a diesel engine (not shown). A separate embodiment of the cast component 10 may be configured as another part for a piece of machinery, industrial equipment, etc.

As shown in each of FIG. 1, the cast component 10 includes an interior feature 12, such as internal cavity, a reentrant angle (an interior angle greater than 180 degrees), or a passage formed by using a core during the casting process. In the particular cylinder head embodiment of the cast component 10, the interior feature 12 is specifically depicted as exhaust passages or runners of the integrated exhaust manifold converging into an exhaust collector. Generally, a core is a disposable item constructed from materials specifically selected to permit the subject core be removed from the cast component 10 after its solidification in the mold. During the casting process, the molten metal generally solidifies at a rate that depends on the design of the mold and the thermal conductivity of the core.

In general, the faster the solidification rate, the finer the cast material microstructure and thus the higher the mechanical properties of the casting. Typically, a sand core has low thermal conductivity and affects coarse material microstructure and low material properties in the finished casting. For example, low cooling rate during solidification of the cast component 10 around an exhaust manifold wall 14 with the use of a sand core may result in a crack 16 (shown in FIG. 1) when the cast component like the cylinder head is subject to engine durability testing or road use, as the particular area experiences high thermal and mechanical stresses. As described in detail below, a hybrid core of various configurations is envisioned to increase local solidification rate of the liquid metal and enhance local material properties of the cast component 10.

Sand cores are typically produced by introducing core sand into specifically configured core boxes, for example half core, dump core, split core, and gang core boxes. Binders may be added to core sands to enhance the core strength. Dry-sand cores are frequently produced in dump core boxes, in which sand is packed into the box and scraped level with the top of the box. A plate, typically constructed from wood or metal, is placed over the box, and then the box with the plate in place is flipped over such that the formed core segment may drop out of the core box. The formed core segment is then baked or otherwise hardened. For complex shape cores, multiple core segments may be hot glued together or joined using other attachment methods.

Simple shape one-piece sand cores may also be produced in split core boxes. A typical split core box is made of two halves and has at least one hole for introduction of sand for the core. Cores with constant cross-sections may be created using specifically configured core-producing extruders. The resultant extrusions are then cut to proper length and hardened. Single-piece cores with more complex shapes may be made in a manner similar to injection moldings and die castings. Following extraction and, if required, assembly of the core segments, rough spots on the surface of the resultant core may be filed or sanded down. Finally, the core is lightly coated with graphite, silica, or mica to give the core a smoother surface finish and greater resistance to heat.

Figure 2:
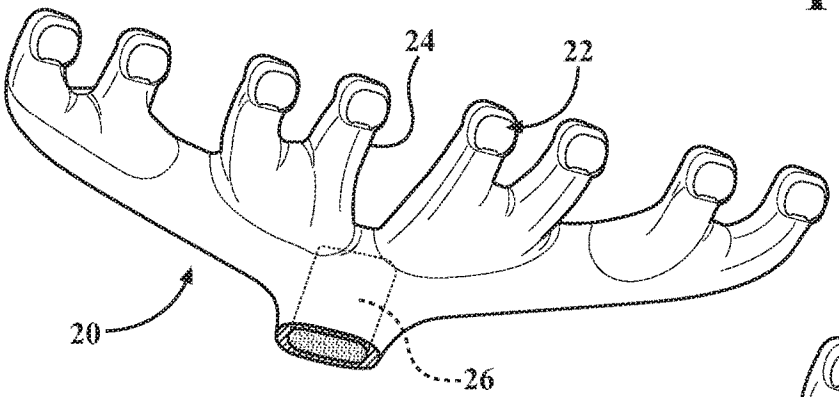
FIG. 2 is a schematic top perspective partial cutaway view of an embodiment of a hybrid casting core having a metal chill element embedded within a sand core portion used to manufacture the interior feature of the cast component shown in FIG. 1, according to the disclosure.
Figure 3:
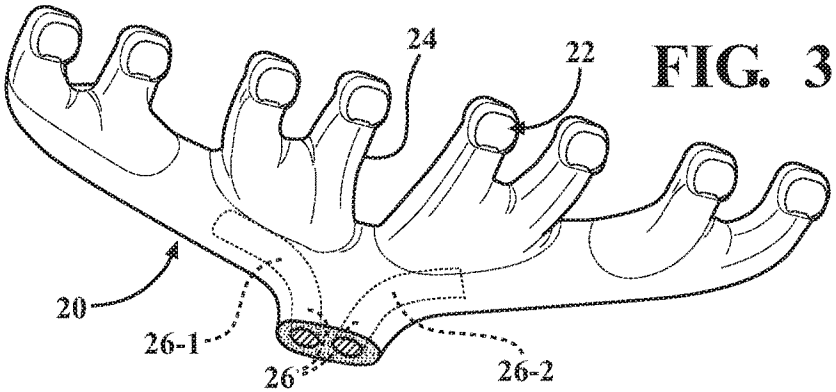
FIG. 3 is a schematic top perspective partial cutaway view of another embodiment of the hybrid casting core having a metal chill element embedded within a sand core portion, according to the disclosure.
Figure 4:
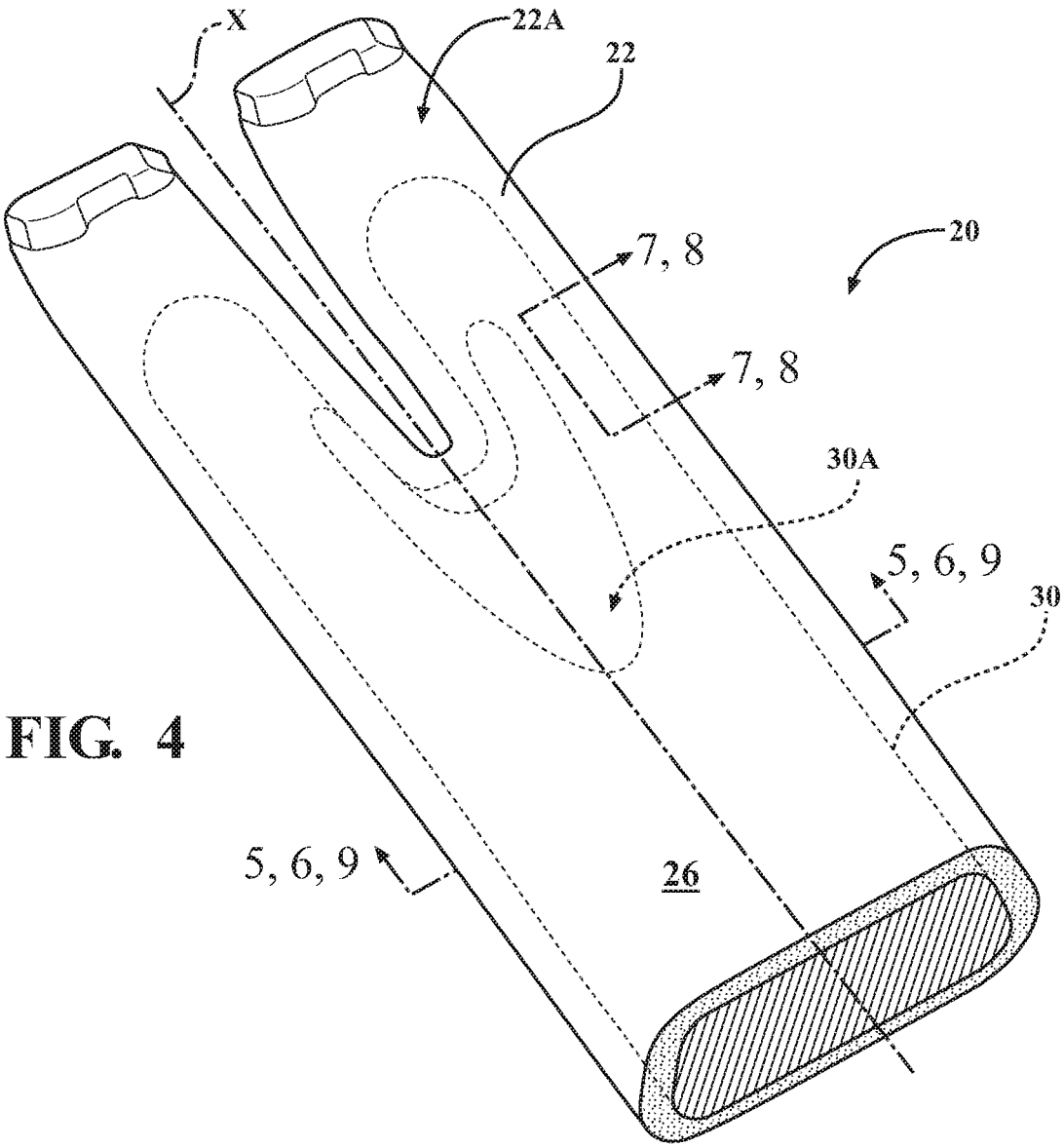
FIG. 4 is a schematic top perspective partial view of the hybrid core shown in FIG. 2.

A hybrid core 20, shown in various configurations in FIGS. 2-4, is configured to address the thermal stress related cracking 16 of the cast component 10, such as in the proximity to the wall 14. Specifically, the hybrid core 20 is intended to increase local solidification rate and enhance local material properties of the finished cast component 10, as needed. The hybrid core 20 is particularly configured for manufacturing the cast component 10, and more particularly for forming the interior feature 12. The hybrid core 20 includes a sand core portion 22. The sand core portion 22 has an exterior shape 24 configured to define the interior feature 12 of the cast component 10. The hybrid core 20 also includes a metal chill element 26 embedded within the sand core portion 22. The metal chill element 26 is configured to locally absorb heat energy from the molten metal during cooling of the cast component 10 and solidification thereof. The hybrid core 20 may be generated by having the sand core portion 22 formed in a core box around one of the embodiments of the metal chill element 26 that are disclosed below.

In general, the metal chill element 26 material should have higher melting temperature than the material used for the actual casting. For cast components manufactured from aluminum, for instance, material selected for the metal chill element 26 may be copper, bronze, cast iron, or tool (stainless) steel. Such metal chill element materials may be employed primarily because of their high thermal conductivity and durability. However, for aluminum castings, when used with a ceramic coating, aluminum (whose melting point is around 660 degrees C.) may also be used as the material for the metal chill element. Another option for the coating is spray-on alcohol-based graphite coating. Such a spray-on coating may include graphite flakes/particles (60~70%), organic bentonite (2-3%), organic binder (1-2%), inorganic binder (1.5-2.5%), polyvinyl butyral (PVB, 0.2-0.5%), additives (2-5%), and remaining mixture based on anhydrous ethanol with other alcohol solvent(s).

The metal chill element 26 is shaped such that it may be either fully embedded within the sand core portion 22 and covered thereby or partially embedded within the sand core portion, thus being partially exposed. The metal chill element 26 is arranged within the mold as part of the hybrid core 20 for cooling the molten metal and thus controlling the solidification rate of the cast component 10 proximate the interior feature 12 during the casting process. By absorbing heat energy from the molten metal, the metal chill element 26 is intended to yield refined microstructure of the casting material and improved mechanical properties of the cast component 10 under operation. Such improved mechanical properties will in turn minimize the likelihood of cracking of the cast component 10. For example, in manufacturing aluminum castings, the metal chill element 26 is intended to enhance localized cooling of the casting, and thereby decrease the cast aluminum material's dendrite arm spacing (DAS), which would improve the strength of the cast component 10 in the region around the interior feature 12.

The metal chill element 26 is additionally shaped such that it may be removed during shake out from the cast component 10 subsequent to the solidification thereof. Of particular importance is the removal of the hybrid core 20 without damaging or otherwise disrupting the structure of the formed cast component 10, which is facilitated by the arrangement of the metal chill element 26 within the sand core portion 22. Specifically, the sand core portion 22 may be initially broken up inside the solidified cast component 10, which will in turn permit the metal chill element 26 to be pulled out of the cast component during the shake out.

Figure 5:
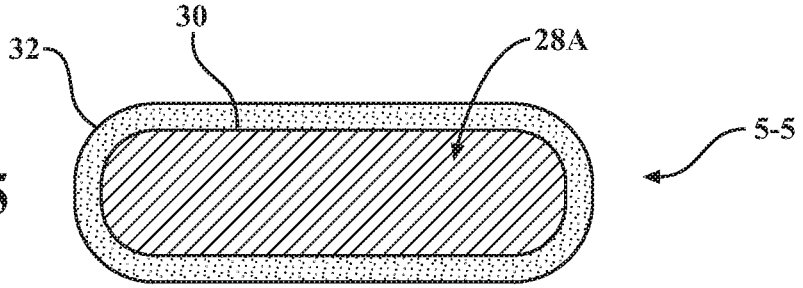
FIG. 5 is a schematic cross-sectional front view of an embodiment of the metal chill element having a coating, according to the disclosure.
Figure 6:
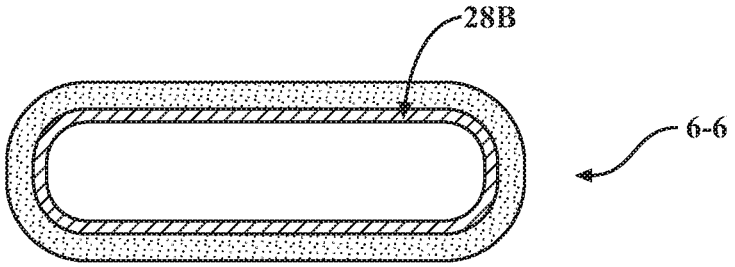
FIG. 6 is a schematic cross-sectional front view of another embodiment of the metal chill element, according to the disclosure.
Figure 7:
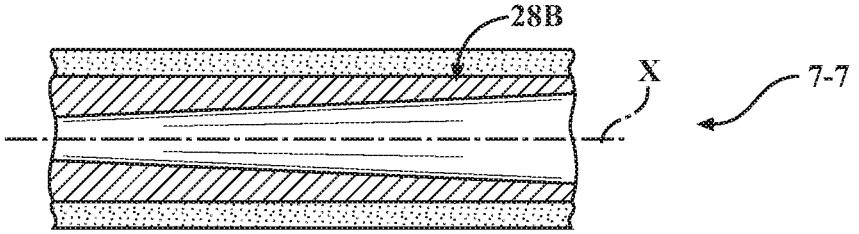
FIG. 7 is a schematic cross-sectional longitudinal view of another embodiment of the metal chill element, according to the disclosure.
Figure 8:
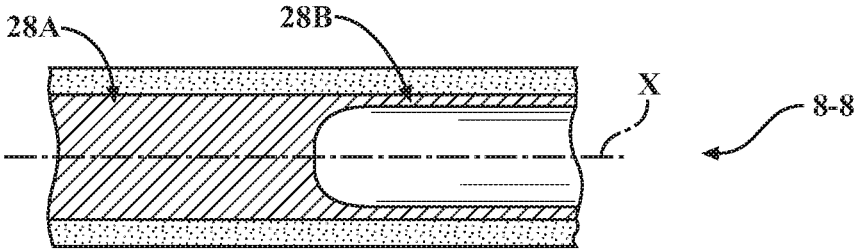
FIG. 8 is a schematic cross-sectional longitudinal view of another embodiment of the metal chill element, according to the disclosure.

As shown in FIG. 5 in a cross-sectional view 5-5, the metal chill element 26 may have a solid cross-section 28A. Alternatively, as shown in a cross-sectional view 6-6 in FIG. 6, the metal chill element 26 may have a hollow cross-section 28B. The hollow cross-section 28B may have a varying thickness along an axis X of the metal chill element 26 (as shown in a cross-sectional view 7-7 in FIG. 7). Additionally, the metal chill element 26 may have a combined or mixed configuration, where the cross-section of one portion 28A is solid and the cross-section of another portion 28B is hollow (as shown in a cross-sectional view 8-8 in FIG. 8). As shown in FIGS. 2 and 4, the metal chill element 26 may have a unitary or single-piece construction. The configuration of the metal chill element 26 shown in FIG. 4 may be generated, for example, by being cast or machined from solid. In general, the metal chill element 26 may be generated by machining, casting, using a specifically configured core-producing extruder, or via a 3D printing process.

Figure 9:
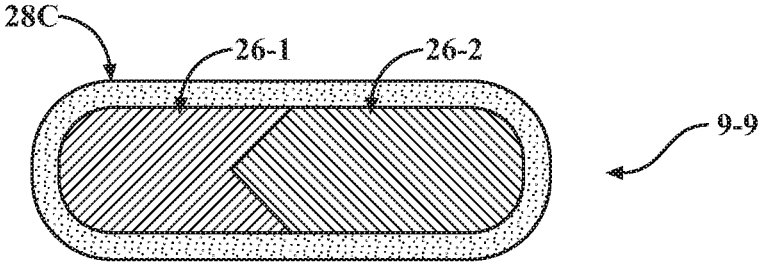
FIG. 9 is a schematic cross-sectional front view of an interconnected multi-piece embodiment of the metal chill element, according to the disclosure.

Alternatively, as shown in FIG. 3, the metal chill element 26 may include a multi-piece construction, e.g., having separate, unlinked and non-contacting respective first and second segments 26-1, 26-2. The metal chill element 26 depicted in FIG. 3 specifically includes non-contacting first and second segments 26-1, 26-2 to facilitate removal of the metal chill element during shake out from the cast component 10. As shown in a cross-sectional view 9-9 in FIG. 9, the metal chill element 26 may have the first segment 26-1 interconnected with the second segment 26-2, i.e., the two pieces being in contact with each other. For example, the first segment 26-1 and the second segment 26-2 may be interconnected or interlocked by fitting together via complementary projections and recesses. Such a configuration of the metal chill element 26 may be used to accurately establish and maintain spacing between the respective individual first and second segments 26-1, 26-2 when the chill element is positioned within the sand core portion 22.

As shown in FIG. 4, the metal chill element 26 may be defined by an exterior surface 30. The exterior surface 30 of the metal chill element 26 may be generally formed such that an exterior shape 30A defined thereby is configured to internally follow an external shape 22A of the sand core portion 22, which is used to form a shape 12A defined by the interior feature 12 of the cast component 10. However, some portions of the metal chill element 26 may protrude beyond the sand core portion 22. During the casting process, such protruding portions of the metal chill element 26 may come in direct contact with the interior feature 12 or other areas of the cast component 10. To address such an eventuality, the metal chill element 26 may include a coating 32 (as shown in the cross-sectional view 5-5 in FIG. 5) applied to the exterior surface 30 thereof.

The coating 32 is specifically intended to minimize possible sticking of the metal chill element 26 to the sand core portion 22 and minimize its sticking to the cast component 10 in areas of direct contact between the metal chill element and the interior feature 12. The coating 32 would be additionally selected to have the least effect on, i.e., not restrict, transfer of heat energy from the cast component 10 to the metal chill element 26. The coating 32 may be applied as a sprayable mold wash. Specific compositions of the mold washes may be: ~30% water, ~10% soluble mineral oil, ~10% Kerosene, ~40% silica flour, and ~10% ceramic powders. To limit the effect of the coating 32 on heat transfer, the composition of the coating may include at least one of ceramic, nitride, silicon, and titanium, for example, according to a non-limiting list, ceramic-aluminide, nitride-aluminide, and titanium-aluminide, silicon-nitride, silicon-carbide, a diamond-like coating, boron nitride, and cerium oxide. To further limit its effect on heat transfer, the coating 32 may have a thickness in a range of 50 nanometers (nm) to 5 micrometers or microns (μm), depending on the sizes of silica flour and ceramic powders used in the wash.

Figure 10:
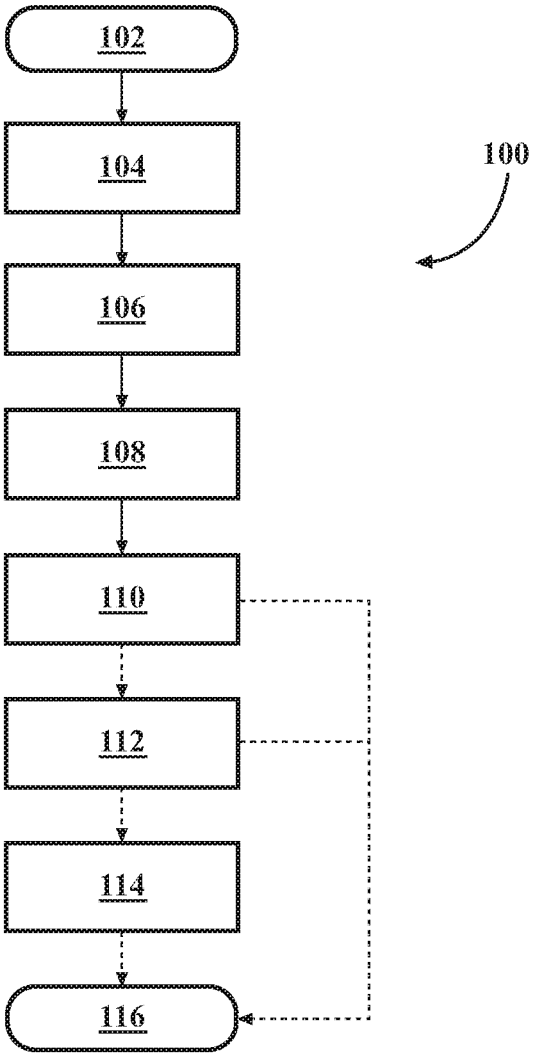
FIG. 10 is a flow diagram of a method of preparing the hybrid core, shown in FIGS. 2-9, for generation of the cast component, according to the disclosure.

A method 100 of preparing the hybrid core 20 for generation of the cast component 10 is shown in FIG. 10 and described below with reference to the structure of the hybrid core shown in FIGS. 2-9. Method 100 commences in frame 102 with generating an embodiment of the metal chill element 26 by one of the above-disclosed approaches. Following frame 102, the method may advance to frame 104. In frame 104, the method includes applying the coating 32 to the exterior surface 30 of the metal chill element 26. After frame 102 or frame 104 the method will move on to frame 106. In frame 106, the method includes arranging the formed metal chill element 26 in a core box. In frame 106, the method may specifically include arrangement or assembly of individual first and second segments 26-1, 26-2 of the metal chill element 26, if appropriate for the specific embodiment of the hybrid core 20.

From frame 106, the method moves on to frame 108, where the method includes introducing and compacting core sand into the core box until the core box is full, e.g., the sand is level with the top of the core box. Following frame 108, the method proceeds to frame 110. In frame 110 the method includes extracting the formed hybrid core 20 from the core box. After frame 110 the method may proceed to frame 112. In frame 112 the method may include hardening the formed hybrid core 20, such as by baking in a furnace at temperatures in the range of 200 to 250 degrees C. Alternatively, if self-hardening sand is used (where typically two or more binder components are mixed with sand), the sand will cure and self-harden at room temperature.

Following frame 112, the method may advance to frame 114. In frame 114 the method includes assembly of individual hybrid core 20 segments, if appropriate for the specific embodiment of the core, and smoothing out, e.g., filing or sanding down, the outer surface of the hybrid core. Additionally, in frame 114 the method may include coating the outer surface of the hybrid core 20 with a suitable compound, such as graphite, silica, or mica to give the hybrid core a smoother surface finish and greater resistance to heat. The method may conclude in frame 116 following one of the frames 110-114, with packaging or storing the hybrid core 20 in preparation for placing thereof in a mold for subsequent generation of the cast component 10.

Figure 11:
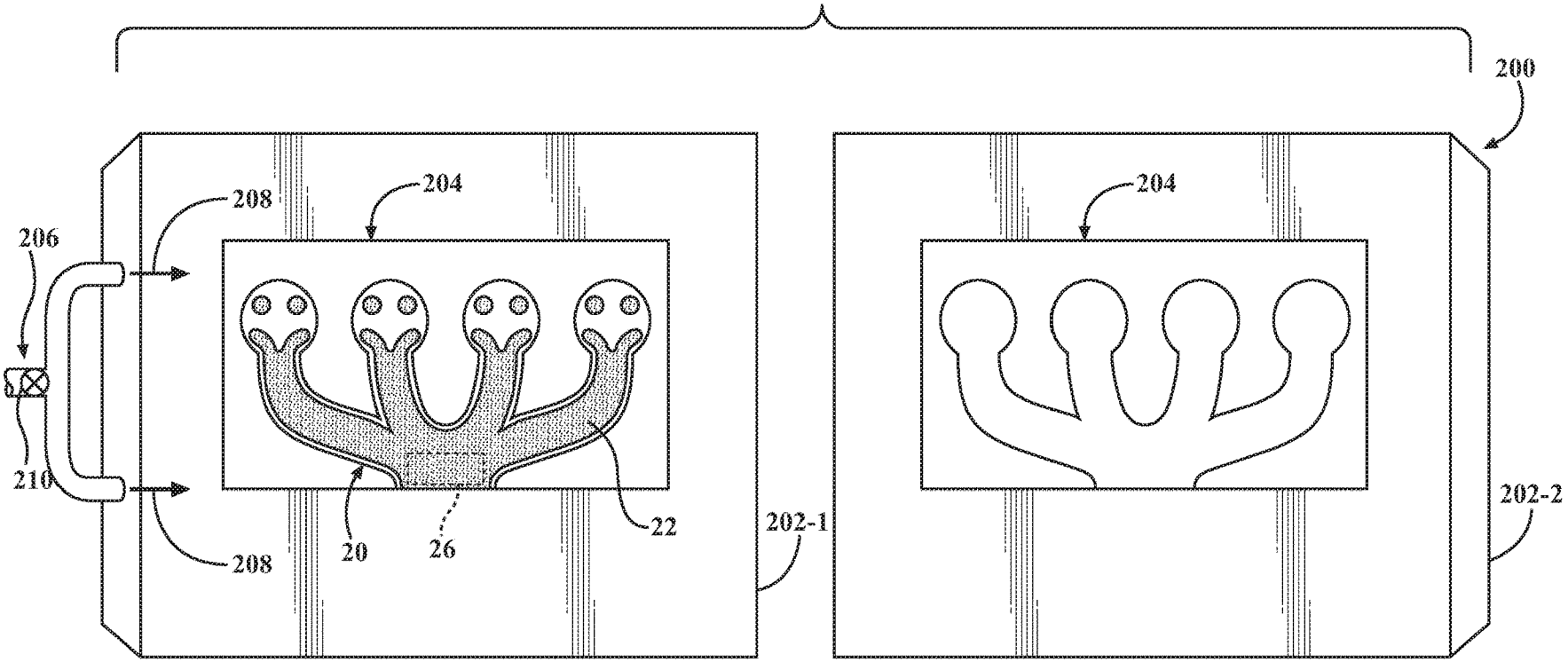
FIG. 11 is a schematic illustration of a system for manufacturing the cast component shown in FIG. 1, the system including the hybrid core shown in FIGS. 2-9, according to the disclosure.

A system 200 for manufacturing the cast component 10 is shown in FIG. 11 and described with reference to method 100 shown in FIG. 10 and the structure of hybrid core 20 shown in FIGS. 2-9. As shown for exemplary purposes, the cast component 10 may be an aluminum cylinder head defining a cast-in integrated exhaust manifold. The system 200 specifically includes a mold 202 having a first or top half 202-1 and a second or bottom half 202-2 and a gating system (not shown). The first half 202-1 and the second half 202-2 of the mold 202 together define an inner cavity 204. The inner cavity 204 is configured to form an exterior shape 10A of the cast component 10. The inner cavity 204 and the gating system may be created by compacting green sand or chemically bonded sand around a pattern, by carving directly into the sand, or by 3D printing.

The system 200 also includes the hybrid core 20, as described above with respect to FIGS. 2-9. The hybrid core 20 is arranged within the inner cavity 204 and configured to define the interior feature 12 of the cast component 10, such as exhaust gas passages of an integrated exhaust manifold. The system 200 further employs a mechanism 206 for introducing a molten metal 208, such as aluminum, into the cavity 204, to thereby form the cast component 10. The mechanism 206 may include a flow valve 210 and a system of runners and risers (not shown), with the valve operatively connected to the mold 202 for supplying the molten metal 208. Operation of the flow valve 210 may be regulated via an electronic controller (not shown). The electronic controller may be programmed to dispense a specific amount of molten metal 208 into the mold 202 at a predetermined material flow rate to ensure appropriate fill of the cavity 204.

When introduced via the mechanism 206, the molten metal 208 flows into the cavity 204 and around the hybrid core 20 to form the exterior shape 10A and the interior feature 12 of the cast component 10. The hybrid core 20, and specifically the metal chill element 26, controls solidification of the molten metal 208 around the interior feature 12 to enhance mechanical properties of the manufactured cast component 10 in the region around the interior feature. The molten metal 208 is permitted to cool and solidify, after which the cast component 10 is removed from the mold. As described above, the hybrid core 20 is removed from the solidified cast component 10 during the core shakeout process, with the brake-up of the sand core portion 22 facilitating extraction of the metal chill element 26 from the casting.

The detailed description and the drawings or figures are supportive and descriptive of the disclosure, but the scope of the disclosure is defined solely by the claims. While some of the best modes and other embodiments for carrying out the claimed disclosure have been described in detail, various alternative designs and embodiments exist for practicing the disclosure defined in the appended claims. Furthermore, the embodiments shown in the drawings or the characteristics of various embodiments mentioned in the present description are not necessarily to be understood as embodiments independent of each other. Rather, it is possible that each of the characteristics described in one of the examples of an embodiment may be combined with one or a plurality of other desired characteristics from other embodiments, resulting in other embodiments not described in words or by reference to the drawings. Accordingly, such other embodiments fall within the framework of the scope of the appended claims.

What is claimed is:

1. A hybrid core for manufacturing a cast component, the hybrid core comprising:

a sand core portion having an exterior shape arranged along a longitudinal axis and configured to define an interior feature of the cast component; and a metal chill element fully embedded within the sand core portion and covered thereby in a cross-sectional view orthogonal to the longitudinal axis and configured to locally absorb heat energy from the cast component during cooling of the cast component and solidification thereof, and constructed and arranged within the sand core portion to be removed during shake out from the cast component subsequent to the solidification thereof.

2. The hybrid core of claim 1, wherein the metal chill element has a solid cross-section.

3. The hybrid core of claim 1, wherein the metal chill element has a hollow cross-section.

4. The hybrid core of claim 1, wherein the metal chill element has a single-piece construction.

5. The hybrid core of claim 1, wherein the metal chill element includes a multi-piece construction configured to facilitate removal of the metal chill element during shake out from the cast component.

6. The hybrid core of claim 5, wherein the metal chill element having the multi-piece construction includes a first piece of the metal chill element interlocked by fitting together via complementary projections and recesses with a second piece of the metal chill element.

7. The hybrid core of claim 1, wherein the metal chill element is defined by an exterior surface, and wherein the metal chill element includes a coating on the exterior surface positioned to contact the cast component and configured to minimize sticking of the metal chill element to the interior feature of the cast component.

8. The hybrid core of claim 7, wherein the coating includes at least one of ceramic, nitride, silicon, and titanium.

9. The hybrid casting core of claim 7, wherein the coating has a thickness in a range of 50 nanometers to 5 microns.

10. The hybrid core of claim 1, wherein the metal chill element has an exterior shape configured to follow a shape of the interior feature of the cast component.

11. A system for manufacturing a cast component, the system comprising:

a mold having a first half and a second half defining an inner cavity configured to form an exterior shape of the cast component;

a hybrid core arranged within the inner cavity of the mold and configured to define an interior feature of the cast component, the hybrid core including:

a sand core portion having an exterior shape arranged along a longitudinal axis and configured to define the interior feature of the cast component; and a metal chill element fully embedded within the sand core portion and covered thereby in a cross-sectional view orthogonal to the longitudinal axis and configured to locally absorb heat energy from the cast component during cooling of the cast component and solidification thereof, and constructed and arranged within the sand core portion to be removed during shake out from the cast component subsequent to the solidification thereof; and a mechanism for introducing a molten material into the cavity to form the cast component such that the molten material flows into the cavity and around the hybrid core to form the exterior shape and the interior feature of the cast component.

12. The system of claim 11, wherein the metal chill element has a solid cross-section.

13. The system of claim 11, wherein the metal chill element has a hollow cross-section.

14. The system of claim 11, wherein the metal chill element has a single-piece construction.

15. The system of claim 11, wherein the metal chill element includes a multi-piece construction configured to facilitate removal of the metal chill element during shake out from the cast component.

16. The system of claim 15, wherein the metal chill element having the multi-piece construction includes a first piece of the metal chill element interlocked by fitting together via complementary projections and recesses with a second piece of the metal chill element.

17. The system of claim 11, wherein the metal chill element is defined by an exterior surface, and wherein the metal chill element includes a coating on the exterior surface positioned to contact the cast component and configured to minimize sticking of the metal chill element to the interior feature of the cast component.

18. The system of claim 17, wherein the coating includes at least one of ceramic, nitride, silicon, and titanium.

19. The system of claim 17, wherein the coating has a thickness in a range of 50 nanometers to 5 microns.

20. The system of claim 11, wherein the metal chill element has an exterior shape configured to follow a shape of the interior feature of the cast component.

* * * * *